US008056384B2

(12) United States Patent
Schwenk

(10) Patent No.: US 8,056,384 B2
(45) Date of Patent: Nov. 15, 2011

(54) PUNCHING METHOD

(75) Inventor: Wilfried Schwenk, Achern-Moesbach (DE)

(73) Assignee: LuK Vermoegensverwaltungsgesellschaft mbH, Buehl (DE)

( * ) Notice: Subject to any disclaimer, the term of this patent is extended or adjusted under 35 U.S.C. 154(b) by 1324 days.

(21) Appl. No.: 10/853,391

(22) Filed: May 25, 2004

(65) Prior Publication Data

US 2004/0250594 A1 Dec. 16, 2004

(30) Foreign Application Priority Data

May 28, 2003 (DE) ..... 103 24 281

(51) Int. Cl.
*B21D 22/21* (2006.01)
*B21D 22/00* (2006.01)

(52) U.S. Cl. ..... 72/348; 72/361

(58) Field of Classification Search ..... 72/296, 72/297, 350, 379.2, 348, 295, 361, 316, 159, 72/308, 352, 356, 360; 416/180; 420/128; 29/557

See application file for complete search history.

(56) References Cited

U.S. PATENT DOCUMENTS

| | | | | | |
|---|---|---|---|---|---|
| 413,374 | A | * | 10/1889 | Paull | 72/352 |
| 448,748 | A | * | 3/1891 | Comings | 493/81 |
| 2,014,815 | A | * | 9/1935 | Rutledge | 493/154 |
| 2,064,160 | A | * | 12/1936 | Hochreiter et. al. | 72/312 |
| 2,378,413 | A | * | 6/1945 | Lermont et. al. | 72/297 |
| 2,605,730 | A | * | 8/1952 | Dennis | 72/336 |
| 2,681,630 | A | * | 6/1954 | Hempel | 72/350 |
| 3,258,954 | A | * | 7/1966 | Dennis | 72/294 |
| 3,262,301 | A | * | 7/1966 | Langworthy | 72/296 |
| 3,664,172 | A | * | 5/1972 | Cvacho | 72/350 |
| 3,789,649 | A | * | 2/1974 | Clowes | 72/350 |
| 4,576,030 | A | * | 3/1986 | Roper | 72/296 |
| 4,833,903 | A | * | 5/1989 | de Smet | 72/57 |
| 5,035,133 | A | * | 7/1991 | White et al. | 72/350 |
| 5,996,391 | A | * | 12/1999 | Mizobuchi | 72/348 |
| 6,032,504 | A | * | 3/2000 | Onat et al. | 72/297 |
| 6,386,981 | B1 | * | 5/2002 | Birk et al. | 464/68.1 |
| 2005/0204541 | A1 | * | 9/2005 | Miyazaki | 29/557 |

FOREIGN PATENT DOCUMENTS

DE 19952143 A1 * 5/2000

* cited by examiner

*Primary Examiner* — Teresa Ekiert
(74) *Attorney, Agent, or Firm* — Davidson, Davidson & Kappel, LLC

(57) ABSTRACT

A method and a device for shaping sheet metal to form a main structure is described, minor structures being created in the planar sheet metal before shaping to form the main structure, which is rotationally symmetrical, for example. This method and device are particularly advantageous because they make it possible to inexpensively and precisely design shell-shaped parts for torque converters, such as a pump shell, a turbine shell or the inner ring of a pump or the inner ring of a turbine.

4 Claims, 5 Drawing Sheets

PUNCHING METHOD

This claims priority to German Patent Application No. 103 24 281.3, filed May 28, 2003 and hereby incorporated by reference herein.

The present invention relates to a method for shaping sheet metal to form a main structure, with minor structures being introduced into the sheet metal before shaping the main structure. In addition, the present invention relates to a device for implementing the method. Furthermore, the present invention relates to a punched part produced according to the present invention and a torque converter having at least one punched part according to the present invention.

BACKGROUND

A known problem in shaping technology is that considerable stresses occur in the sheet metal material due to punching, embossing, deep drawing, etc., so that the shape of the finished part is predictable only in combination with numerous empirical values and/or highly complex computation methods.

If a punched part (referred to hereinafter as the main structure) does not contain any holes or other recesses (referred to below as minor structures), then the spatial position of these minor structures with respect to the main structure is usually controllable only with a great loss of quality.

It is particularly difficult to implement the geometric and positional tolerance of minor structures in a punched part if the thickness of the sheet metal is great in relation to a degree of shaping. In other words, in the case of a shell-shaped part having an inside diameter of 200-300 mm, for example, the sheet metal is bent almost at a right angle and the thickness of the sheet metal here amounts to approximately 4-6 mm, so considerable deformation of the sheet metal may be expected in the shaping area. This deformation means that the shape of minor structures previously created in the sheet metal may be distorted and thus they may not have a high geometrical and positional accuracy.

Shaping sheet metal to yield a pump shell of a torque converter is a particular problem. The pump shell here is the housing part of a torque converter which accommodates the pump blades. This pump shell has a wall thickness of 5 mm, for example, and an inside diameter of 240 mm. With these dimensions, the rated torque is approximately 300 Nm. To accommodate the pump blades, embossed slots are provided in the inside surface of the pump shell so that the pump blades are then inserted into the slots and soldered there. In order for the blades to have a high positional accuracy, they are mostly guided via three embossed slots in the area of the surfaces of the pump shell. For the plurality of blades in the pump shell, this results in annular rows of embossed slots near the axis of rotation, approximately at the most elevated point in the shell and very close to the outside diameter. To achieve a high precision for the position and shape of the embossed slots, these slots have in the past been introduced into the completely punched shell form via a special machine (called a copy machine). With this special machine, at least one ram, i.e. a stamping device, is directed radially at the inside surface of the pump shell. A corresponding counter-die is oriented with the outside surface of the pump shell at the particular location. By embossing the embossed slots on the inside of the pump shell in cycles with subsequent advancing of the workpiece to the next embossing position, a row of embossed slots is manufactured. For example, when there are 31 pump blades, these slots must be embossed 31 times and then the workpiece must be turned. Even if the special machine mentioned is able to punch all three "rings" of embossed slots simultaneously, 31 cycles are nevertheless required to produce them in this example.

BRIEF SUMMARY OF THE INVENTION

The enormous manufacturing complexity required for a pump shell of a torque converter thus results in a high cost. Therefore, an object of the present invention is to provide a method and/or a device which will reduce the high cost while at the same time retaining high quality, i.e., precision of the geometric and positional tolerance.

Because of the shell-shaped structure, it is impossible to punch embossed slots close to a steep edge. Because of its essentially vertical embossing direction, an embossing ram would actually strike the inside surface of the shell at an extremely acute angle, in particular in the case of embossed slots close to the shell-shaped edge. Therefore, the embossing ram would be massively deflected, which could even result in breakage of the embossing ram. It must be recalled here that an embossed slot for a pump blade may be only 1.2 mm wide, so that such a ram would have no stability with respect to bending. However, even if an embossing ram had sufficient strength for the mechanical stresses, the resulting shape of the embossed slots would not be clearly defined due to the embossing direction of the embossing rams. In addition, an embossing ram would be exposed to enormous wear because the friction on the embossing ram against the workpiece or against the ram guide plate would also have a destructive effect.

According to the present invention, embossed slots (or slots for turbine blades of a torque converter) are introduced into sheet metal while it is still planar. In other words, the sheet metal has not yet undergone any conversion to a shell structure, also referred to as the main structure. The embossing and punching of the embossed slots and/or slots in a planar material make it possible for all the slots to be formed with one press stroke. In the case of 31 pump blades and three attachment points per blade, i.e., a total of 93 embossed slots for the pump shell alone, this would be accomplished with a single press stroke.

The disadvantages of the related art were known to those of skill in the art but shaping a sheet metal part having minor structures to form a rotationally symmetrical main structure, for example, was not seen to be possible without distorting or destroying the minor structures, i.e., to produce it with a sufficient geometric and/or positional accuracy. According to the present invention, a part of the sheet metal is clamped between the top and bottom parts of a punching die while another area of the sheet metal is shaped by the contour of the punching die. If the minor structures in the sheet metal to be shaped are embossed slots—i.e., embossed shapes—then the die will have recesses in the area of the elevated structures so that there will be no damage to the embossed slots due to the force acting in clamping or shaping.

In another embodiment of the present invention, shaping is not performed in a single pressing operation but instead in multiple pressing operations. In order for such a punching or shaping die not to be too complicated and thus too expensive, it is advantageous if the shaping is performed not only in multiple shaping steps but also in successive dies. Each die is then designed for a partial function and may therefore have a simpler design. Shaping in multiple shaping steps also has the advantage that pressing (swaging, squeezing, etc.) of the material need not take place in a single operation because despite all the professional experience of a die designer and despite all the complex modern finite element computation programs, it remains an art to correctly calculate in advance the "material flow" in cold shaping of sheet metal.

As already mentioned above, the shell shape is a subset of a rotationally symmetrical main structure. A main structure is in principle advantageous in comparison with any other hollow embossed main structure because flow processes of the material to be worked there are homogeneous in the radial direction. However, the present invention is not limited to rotationally symmetrical main structures.

The degree of difficulty in shaping sheet metal into a shell-shaped main structure is even greater when an additional elevation is formed in the vicinity of the axis of rotation. This additional elevation exists in the pump shells or turbine shells of a torque converter, for example. The converter hub is then welded onto the elevation in the pump shell and drives an oil delivery pump during operation of the converter.

As part of the present invention, however, the minor structures—for example the slots—are not only produced by punching but may also be created in other ways in the sheet metal, for example by lasers. The actual idea according to the present invention is not limited exclusively to shaping technology.

In another embodiment of the present invention, the sheet metal to be worked is swaged in a defined manner. In other words, if the sheet metal is pressed into the form of a shell, it yields an edge of the shell which extends essentially into or opposite the direction of punching. In the shaping step to form the shell, the sheet metal resists sharp-edged shaping in its "flow." However, if sharp-edged shaping is necessary for technological reasons, then it is possible to implement an essentially sharp-edged shell shape by swaging—at least in a partial area of the shell. As part of the description of the figures, this point of the present invention will be discussed again further.

BRIEF DESCRIPTION OF THE DRAWINGS

The present invention will now be explained in greater detail below on the basis of the figures.

DETAILED DESCRIPTION

Figure 1:
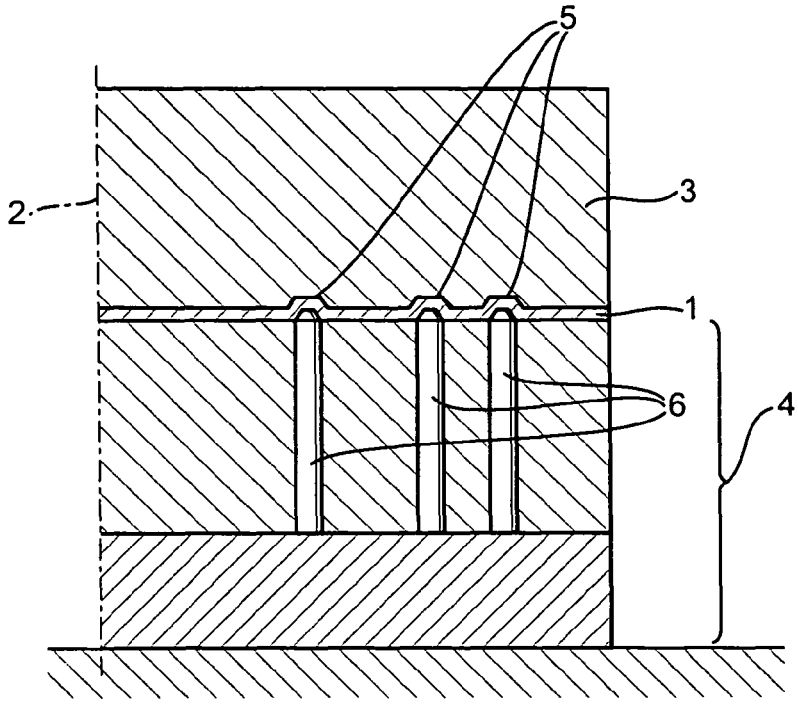
FIG. 1 shows a semi-sectional view through an embossing die for embossed slots.

FIG. 1 shows a simple punching die in which sheet metal 1 (a workpiece) is situated between a top part 3 and a bottom part 4. A vertical axis 2 of rotation shows that the drawing of the punching die has mirror symmetry. Embossing rams 6 are cut in an upper plate of bottom part 4. Embossing rams 6 have in common the fact that they do not penetrate through sheet metal 1 but instead they form a slot on the bottom side of sheet metal 1 and a matching bulge on the top side of sheet metal 1.

In a next machining step, sheet metal 1 undergoes a shell-shaped shaping in its area near axis 2 of rotation. Since the examples illustrated in FIGS. 1 through 5 show the production of a pump shell for a torque converter; and the pump shell is situated with its axial main opening facing down during manufacture, the inner shell-shaped shaping of FIG. 2 may be referred to as an additional central elevation 15 (FIG. 6*a*) of the pump shell. It is also characteristic in FIG. 2 that the elevations of embossed slot 5 are not covered by the adjacent die part over the entire area.

Figure 2:
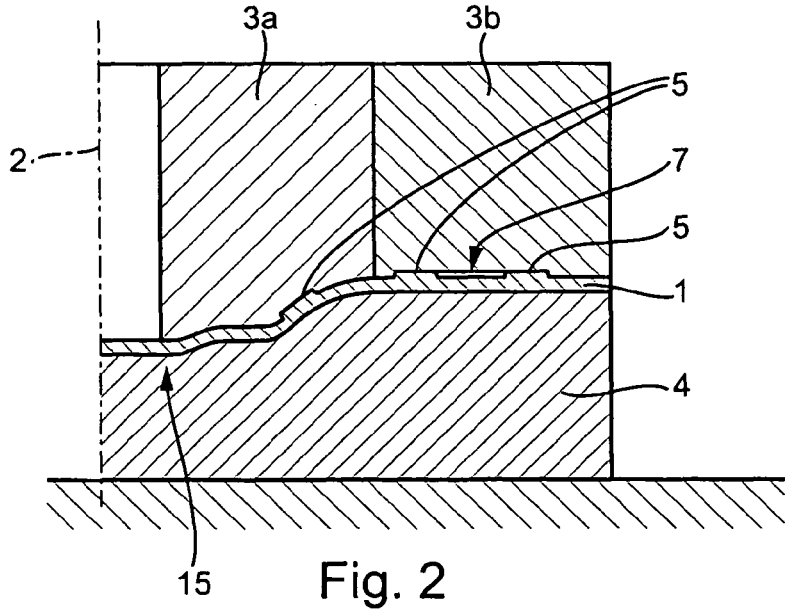
FIG. 2 shows a semi-sectional view through a punching die for shaping a shell shape which is on the inside radially.

Top part 3 in FIG. 2 is divided into two ring-shaped top parts 3*a*, 3*b*. Outer ring-shaped part 3*b* is first advanced toward sheet metal 1 during this machining step, with the outer area of the future pump shell being clamped against die bottom part 4. When this clamping has taken place, top part 3*a* may also be moved downward so that the radially inside area of sheet metal 1 is shaped. The clamping of the radially outer area of sheet metal 1 essentially does not result in deformation of the sheet metal area. The desired position of the inner ring of embossed slots is achieved by suitably matching bottom part 4 and top part 3*a* in the radially inside area of the sheet metal form. The suitable matching mentioned here requires a high measure of technical expertise because even highly complex finite element computation programs for the "flow" behavior of sheet metal 1 are used in combination with long years of professional experience.

The illustrations in FIGS. 1 through 6*a* and 7*a* are greatly simplified in order to clarify the present invention. The present invention includes a control unit for the method steps of "clamping the sheet metal" and "shaping the sheet metal" by controlling the clamping and the dies. In this embodiment the clamping may intentionally be designed to be elastic. Due to this elasticity, there may be defined creep (slippage) of sheet metal 1 in the direction across axis 2 of rotation. This creep of the sheet metal may be very advantageous if, for example, radial tensile stresses of the sheet metal during the shaping operation are to be limited to a defined maximum value. Elastic clamping may be implemented, for example, via a powerful prestressed spring or by hydraulic pressure—which is again preferably capable of being regulated.

Figure 3:
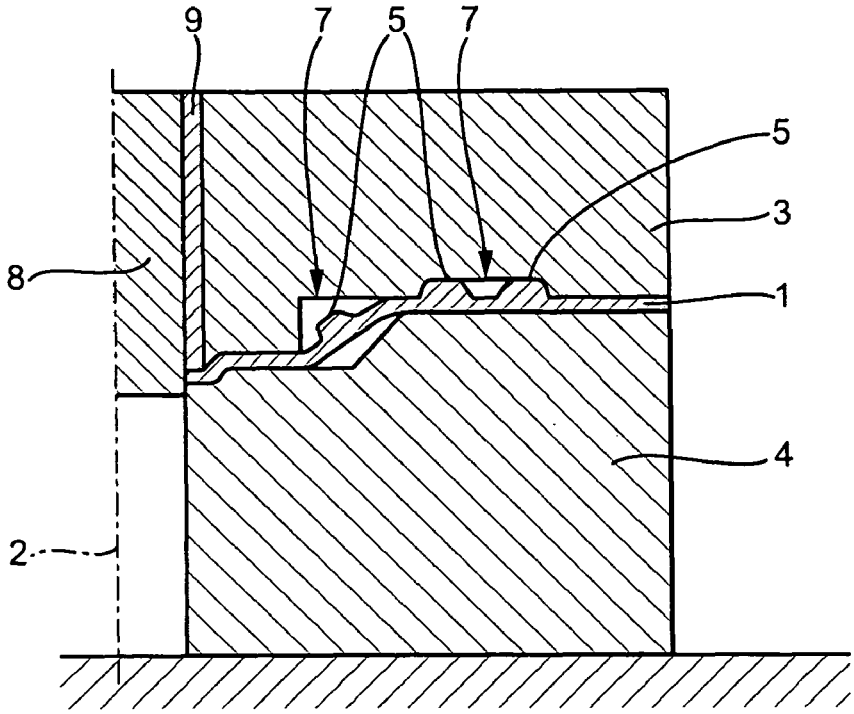
FIG. 3 shows a semi-sectional view through a punching die for perforating, cutting and embossing a shell structure which is on the inside radially.

In FIG. 3 perforations are created by a hole-punch 8 in sheet metal 1. After the hole has been punched, an embossing ram 9 travels toward sheet metal 1, thereby creating a shoulder. As mentioned above, sheet metal 1 is a pump shell for a torque converter, so the surface created by embossing ram 9 represents the seat for a hub which is welded at this point. The die in FIG. 3 is again characterized in that cavities 7 are situated in the area of the bulge of embossed slots 5 so that they do not impair the shape and/or position of the embossed slots. Sheet metal 1 is clamped on the outer edge and close to the center of top part 3 and bottom part 4.

Figure 4:
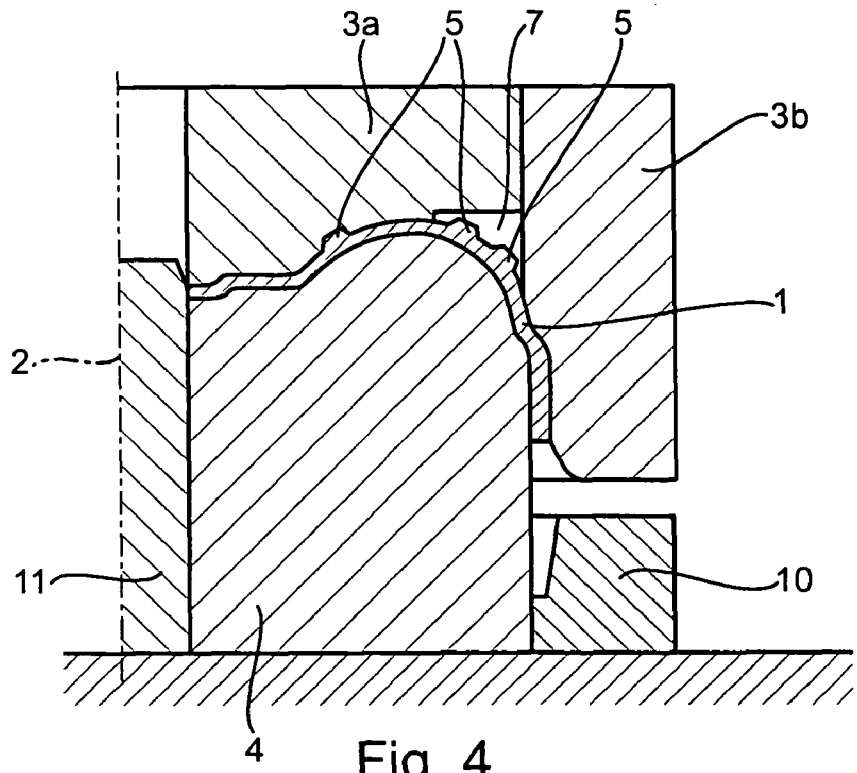
FIG. 4 shows a semi-sectional view through a die for shaping a shell shape which is on the outside radially.

The punching die depicted in FIG. 4 shapes the radially outer region of sheet metal 1 and/or the pump shell. Sheet metal 1 is centered at its center by a guide mandrel 11. Bottom part 4 together with top part 3*a* clamps sheet metal 1. After clamping, the radially outer region of top part 3*b* (also known as the drawing ring) is pulled downward and thus forms the edge of a shell. Two ring-shaped rows of embossed slots 5 are again situated here in a cavity 7. The region of sheet metal 1 shaped on the dividing line between bottom part 4 and top part 3*b* is here essentially designed in an S shape. After top parts 3*a*, 3*b* have been raised up from sheet metal 1, the workpiece may be raised from bottom part 4 by a stripper 10.

Figure 5:
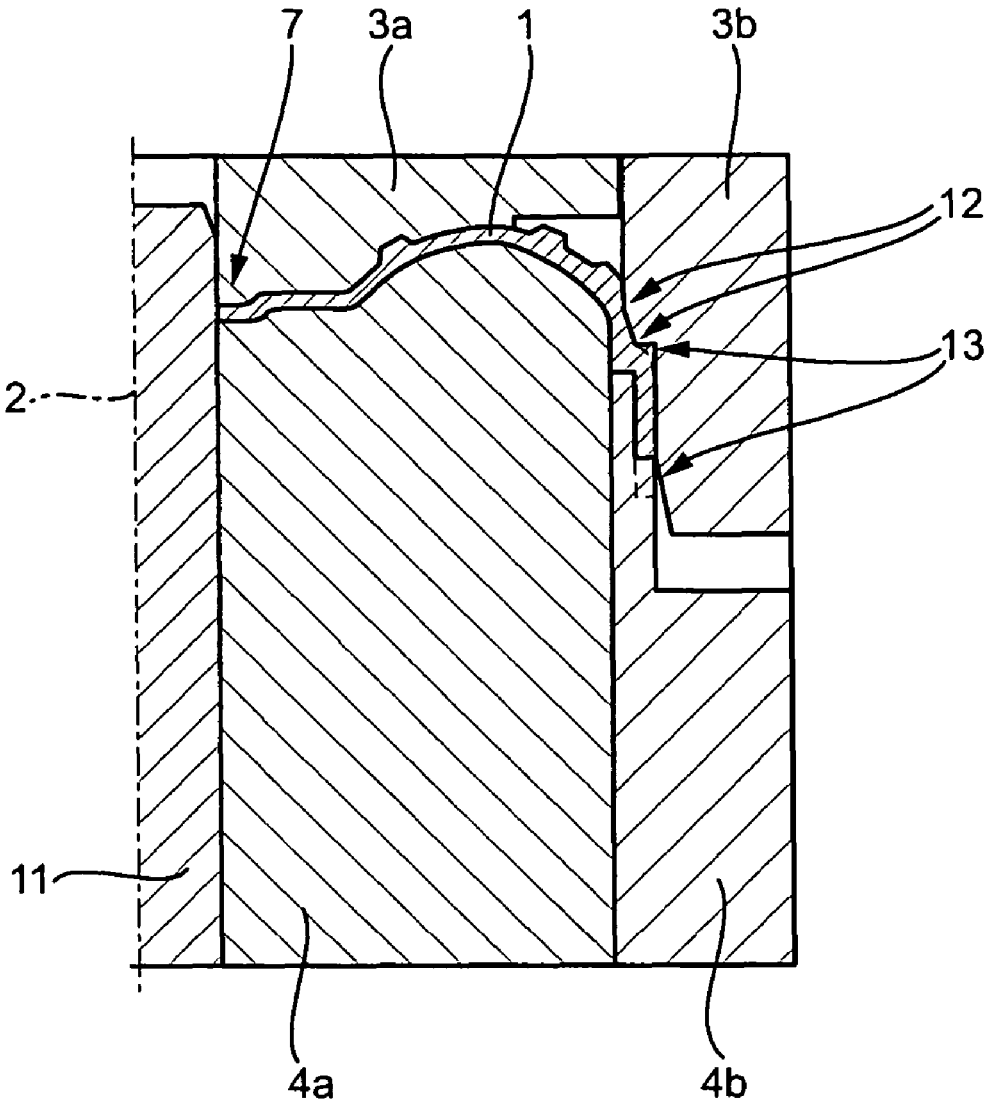
FIG. 5 shows a semi-sectional view through a die for swaging a shell shape which is on the outside radially.

At first glance, the punching die from FIG. 5 hardly seems to differ from the punching die in FIG. 4. Shell-shaped sheet metal part 1, including central elevation 15, is shown here after the shaping operation. By observing carefully, it is possible to see that the S-shaped edge of sheet metal 1 from FIG. 4 now has a sharp edge. This sharp edge may be of great importance for the pump half shell of a torque converter because after the pump half shell and the second shell, the driver half shell have been joined together, the edges of the shells should approach one another as closely as possible so that no axial gap would remain between the two, which would significantly impair the efficiency of a torque converter.

Swaging, however, not only has the function of creating a sharp-edged contour, depending on the application, but also overstretched sheet metal thicknesses which have thus been stretched to a thickness below their wall thickness are swaged back to their initial thickness by swaging. The relatively elongated S shape of FIG. 4 may be converted by swaging to an S shape having pronounced deflections.

The sharp-edged design of sheet metal part 1 (the pump half shell of a torque converter in the present example) is achieved by swaging on the edge of sheet metal part 1 extending axially. For swaging, parts 3*b* and 4*a* move toward one another in FIG. 5. This causes "filling" spaces 13—which are discemable here as corners—to be filled with material. To prevent more of the sheet metal material from slipping away, at least one peripheral ring tooth 12 is situated in top part 3*b*. This ring tooth 12 prevents material of sheet metal 1 from being pressed between parts 3*a* and 4*a* of the punching die during swaging. Thus the edge area, which is usually dominated only by tensile and radial stresses, may be converted to a sharp-edged geometry. Ring-shaped outer part 4*b* of the bottom part may advantageously also be used as a stripper. This swaging of an edge to create essentially sharp-edged shapes may be used not only with the method according to the present invention, however, but may also be used with other shaping operations.

In another embodiment of the present invention, swaging is not accomplished in a single operation. In another punching die, which is also designed for swaging the shell, the edge contour of the shell is swaged once again. The edge height of such a shell having a wall thickness of approximately 5 mm may still be swaged by 2 mm. Dividing the punching between two punching dies (which are actually swaging dies here) has the advantage that the extreme load for the swaging need not be accomplished with a single die, which would require a disproportionately resistant die to be created, but which would be disproportionately expensive and would require a peak force. This die would then constitute an extreme stress in the arrangement of the punching dies in the subsequent step, so that the bed plate of the press would be under a disproportionately high stress. It is therefore advantageous to divide the swaging between two punching dies because this reduces the individual pressing force. It is also advantageous because a lubricant and/or parting compound may then also be applied to the workpiece and/or the die between the individual swaging operations.

Figure 6A:
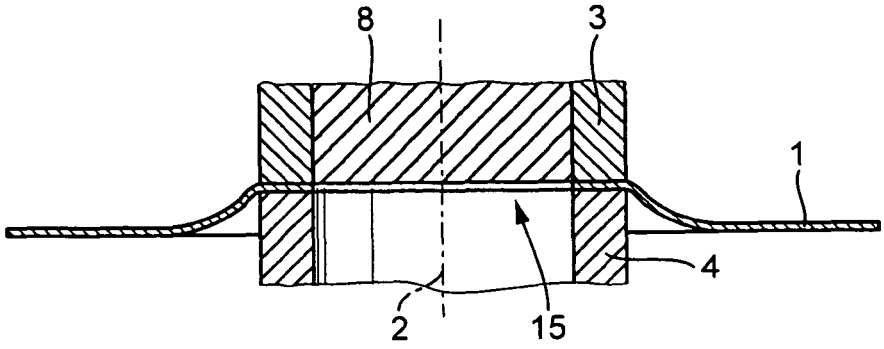
FIG. 6*a* shows a section through a die for perforating a turbine shell at the center.
Figure 6B:
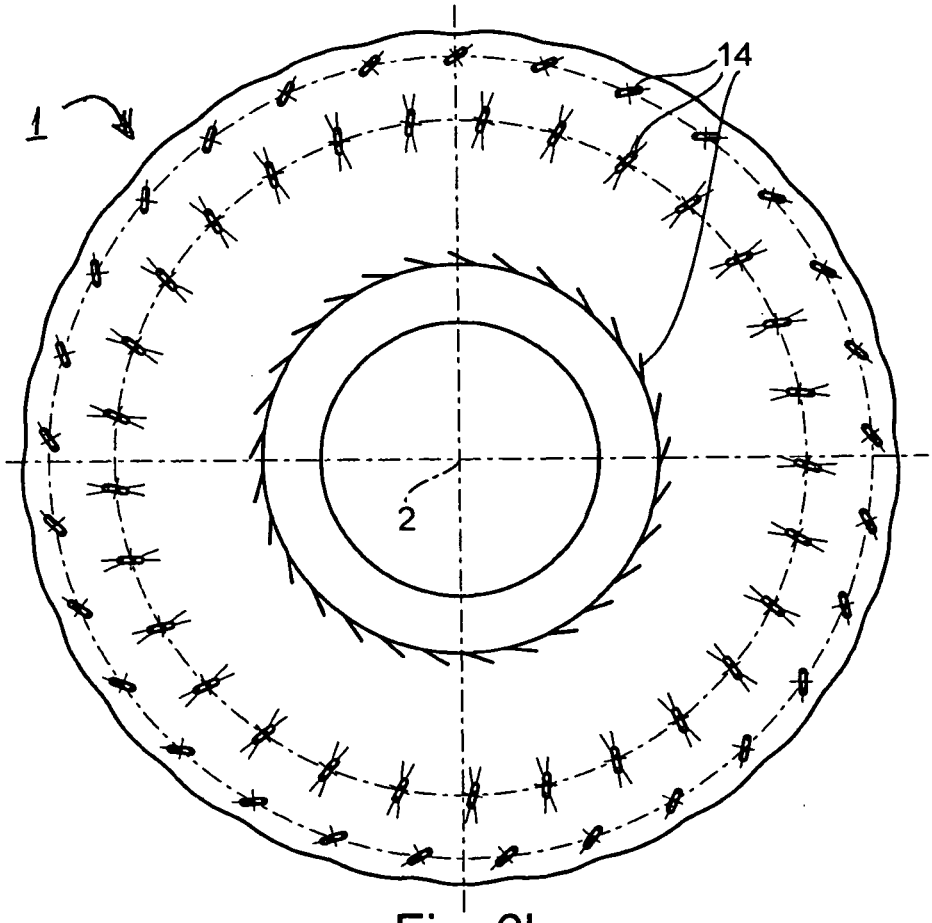
FIG. 6*b* shows a top view of the turbine shell from FIG. 6*a*.
Figure 7A:
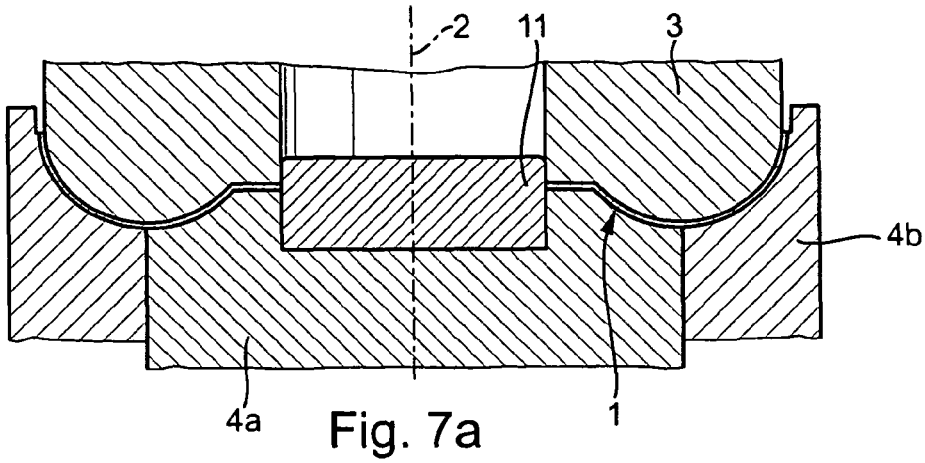
FIG. 7*a* shows a section through a die for finishing the shell shape.
Figure 7B:
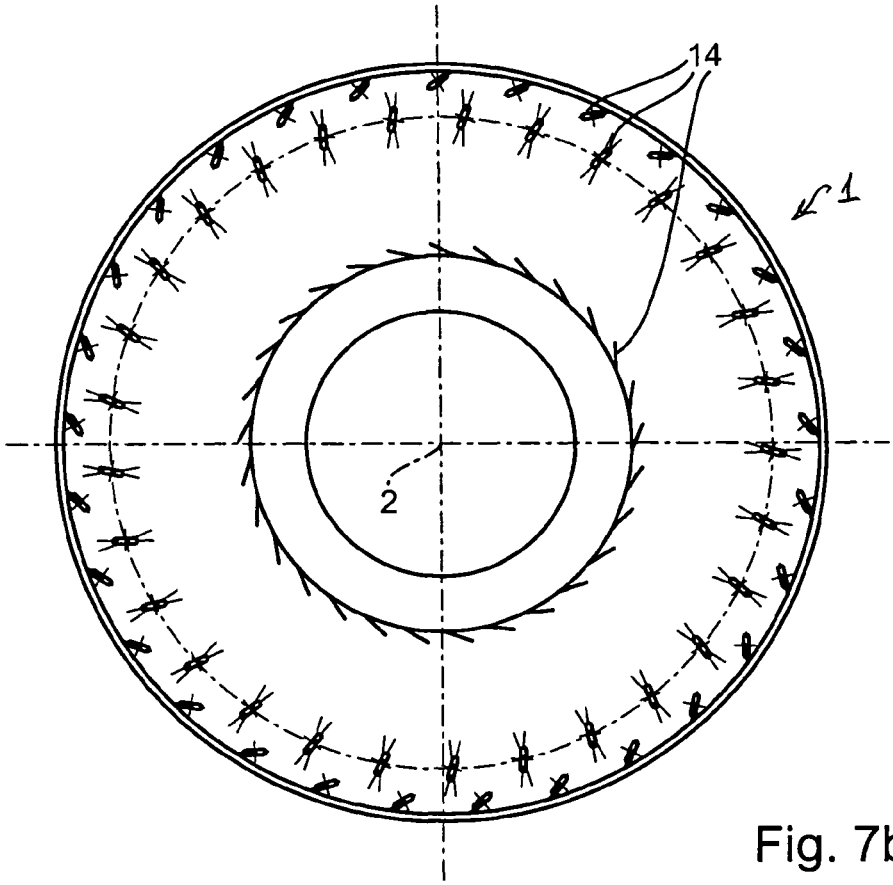
FIG. 7*b* shows a top view of the turbine shell from FIG. 7*a*.

FIGS. 6*a*, 6*b* and 7*a*, 7*b* may be considered together. FIGS. 6*a* and 7*a* each represent an axial section, while FIGS. 6*b* and 7*b* each represent a top view of the workpiece in the corresponding manufacturing phase. FIG. 6*a* shows sheet metal 1 (in this case a turbine shell which has previously been only half finished for a torque converter). Previously sheet metal 1 in a flat condition has been provided with slot 14 passing all the way through the sheet metal and in its inner radial area it has been provided with an elevation 15. As shown in conjunction with FIG. 6*b*, sheet metal 1 is not only much thinner in relation to a pump shell but is also more of a filigree design because of through-slots 14 and therefore is also much less subject to distortion in punching than a pump shell would be. For punching out the inner round disk, only one punching die is necessary, supporting the central area with its top part 3 and bottom part 4. However, the punching die may also be designed within the scope of the present invention so that it supports and/or clamps the outer radial edge of sheet metal 1, which is so far still planar.

FIG. 6*b* illustrates another idea according to the present invention. The outside edge of sheet metal part 1 shown is not exactly circular but instead has periodic variations in radius that correlate with the occurrence of outer slots 14. Since the outer slots are aligned to a radial line at an angle of 45 degrees, these slots 14 may be deformed in a particular manner in shaping the edge of the sheet metal. Depending on the shaping stresses that occur, they may either become longer or the slots may become broader or the slots may even be opened completely to the edge. To counteract this negative effect, the edge of sheet metal 1 is reinforced in a defined manner at certain locations and/or has been weakened in a defined manner at the locations in between. In the exemplary embodiment in FIG. 6*b*, the radius has been reduced in the area of a slot on the outside while the radius between the slots has been increased slightly.

In another punching die (shown here with FIG. 7*a*) sheet metal 1 has been centered on a guide mandrel 11. After top part 3 and inside ram 4*a* of bottom part 4 are moved toward one another, sheet metal 1 is clamped in its radial inside area. If ring-shaped outer part 4*b* of bottom part 4 is now moved toward top part 3, sheet metal 1 is shaped to a complete shell. As shown clearly in FIG. 7*b*, after shaping, the outer slots (in relation to the axial projection of the drawing) are situated almost beneath the edge of the shell. In this example in particular, it is clear that a manufacturing method for pump shells or turbine shells in which the punching direction for the slots (or for the embossed slots) is in the direction in which the shell is also punched is not practicable. In this way, inner pump rings or inner turbine rings may be manufactured according to the present invention.

Sheet metal 1 undergoes severe deformation in particular in the edge area that is on the outside radially in FIG. 7*a*. It is therefore advantageous if either top part 3 or bottom part 4 is not only manufactured in two parts but is instead manufactured in three or four parts. In the example in FIG. 7*a*, it might appear as if part 4*a* does not extend to the vertex, i.e., to the bottom point of the shell, but instead ends farther toward the inside radially. Another part 4*c*, which could be situated between parts 4*a* and 4*b*, could influence the "flow" process of the material via controlled clamping, or even a controlled pressing force could be involved in the shaping operation. In this way, severe shaping could be implemented cautiously. However, as part of the present invention, the top part may also be designed in several parts. By intentional overlapping of clamping and shaping parts Oust as parts 4*a* and 4*b* are overlapped by top part 3 in the area of the vertex of the shell in FIG. 7*a*), an adequate stability is nevertheless available for the entire punching die and for sheet metal 1, which is to be machined during the shaping operation.

Unusually high degrees of precision are achievable by the method according to the present invention in combination with this device. The minor structures may thus be implemented with a tolerance of ±0.05 mm to ±1.0 mm, preferably with a tolerance of ±0.1 mm to ±0.5 mm in the radial direction—in relation to the coordinates of the main structure. The same values also apply to the tolerances in the axial direction. As indicated by the position of the minor structures in relation to the center of the main structure in angle degrees, a tolerance of ±0.05 degree to ±1.0 degree, preferably ±0.1 degree to ±0.5 degree is possible.

The shape of the minor structure after shaping may also be implemented with a high precision. A precision having a tolerance of ±0.05 mm to ±0.5 mm, preferably even ±0.1 mm to ±0.2 mm is thus possible.

What is claimed is:

1. A method for shaping a sheet metal using a die, the sheet metal after shaping having at least a minor structure, and a basically rotational symmetrically main structure, the method comprising:

stamping a minor structure into a flat sheet metal defining a first plane in a minor structure stamp direction;

stamping a main structure in a main structure stamp direction after the stamping of the minor structure, so that at least part of the minor structure is moved out of the first plane so as to form a torque converter part, at least a portion of the sheet metal not currently being shaped being clamped by at least part of the die during shaping of another portion; and swaging the sheet metal, after the step of shaping another portion of the sheet metal, at least one region of the sheet metal extending axially with aid of a shaping die by pressing on at least one end face of the sheet metal.

2. The method as recited in claim 1 wherein the sheet metal is swaged into cavities.

3. The method as recited in claim 2 wherein the swaging is performed in at least two steps.

4. The method as recited in claim 3 wherein the sheet metal is placed into another die for at least one additional swaging operation.

* * * * *